US006419783B1

(12) United States Patent
Rainey et al.

(10) Patent No.: US 6,419,783 B1
(45) Date of Patent: Jul. 16, 2002

(54) CONTAINER AND CLOSURE

(75) Inventors: Dean Rainey, Clinton; James Lynn Turbett, Darien, both of CT (US)

(73) Assignee: Unilever Home & Personal Care USA, Greenwich, CT (US)

( * ) Notice: Subject to any disclaimer, the term of this patent is extended or adjusted under 35 U.S.C. 154(b) by 0 days.

(21) Appl. No.: 09/293,729

(22) Filed: Apr. 16, 1999

(51) Int. Cl.[7] ..... B32B 31/00
(52) U.S. Cl. ..... 156/297; 156/325; 222/94
(58) Field of Search ..... 156/297, 325, 156/326, 327; 222/94, 105, 145.3

(56) References Cited

U.S. PATENT DOCUMENTS

| | | | | |
|---|---|---|---|---|
| 3,269,389 A | | 8/1966 | Meurer et al. | |
| 4,412,030 A | * | 10/1983 | Runavot et al. | 524/505 |
| 4,964,539 A | | 10/1990 | Mueller | |
| 4,974,756 A | | 12/1990 | Pearson et al. | |
| 5,052,590 A | | 10/1991 | Ratcliff | |
| 5,137,178 A | | 8/1992 | Stokes et al. | |
| D329,984 S | | 10/1992 | Walravens | |
| 5,152,432 A | | 10/1992 | DeLaforcade | |
| 5,158,209 A | | 10/1992 | Reil et al. | |
| 5,244,120 A | | 9/1993 | O'Meara | |
| 5,252,312 A | | 10/1993 | Gentile et al. | |
| 5,269,441 A | | 12/1993 | O'Meara | |
| 5,289,949 A | | 3/1994 | Gentile | |
| 5,289,950 A | | 3/1994 | Gentile | |
| 5,316,159 A | | 5/1994 | Douglas et al. | |
| 5,318,203 A | | 6/1994 | Iaia et al. | |
| D353,326 S | | 12/1994 | Abfier et al. | |
| 5,386,928 A | | 2/1995 | Blette | |
| 5,392,947 A | | 2/1995 | Gentile | |
| 5,489,046 A | | 2/1996 | Wickham | |
| 5,612,307 A | | 3/1997 | Chambers et al. | |
| 5,615,803 A | | 4/1997 | Hatakeyama et al. | |
| 5,626,262 A | | 5/1997 | Fitton et al. | |
| 5,628,429 A | | 5/1997 | Usen et al. | |
| 5,989,385 A | * | 11/1999 | Oeltjen et al. | 156/330.9 |

FOREIGN PATENT DOCUMENTS

| | | |
|---|---|---|
| DE | 42 16 191 | 11/1993 |
| DE | 297 17 244 | 1/1998 |
| EP | 807 471 | 11/1997 |
| GB | 2 179 075 | 2/1987 |
| WO | 98/29320 | 7/1998 |

* cited by examiner

*Primary Examiner*—James Sells
(74) *Attorney, Agent, or Firm*—Gerard J. McGowan, Jr.

(57) ABSTRACT

A dual container wherein two chambers are secured together by at least two different adhering agents to maintain integrity over a range of temperatures. The adhering agents may be used to adhere other objects together as well. Preferably, the adhering agents are hot melts.

16 Claims, 6 Drawing Sheets

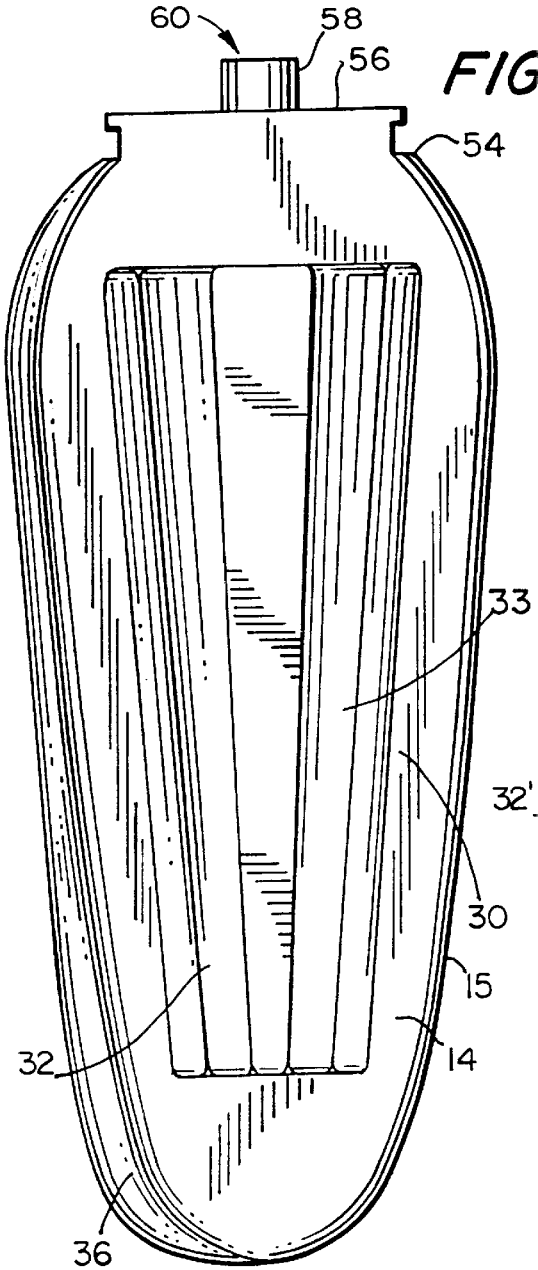
FIG. 4A
FIG. 4B
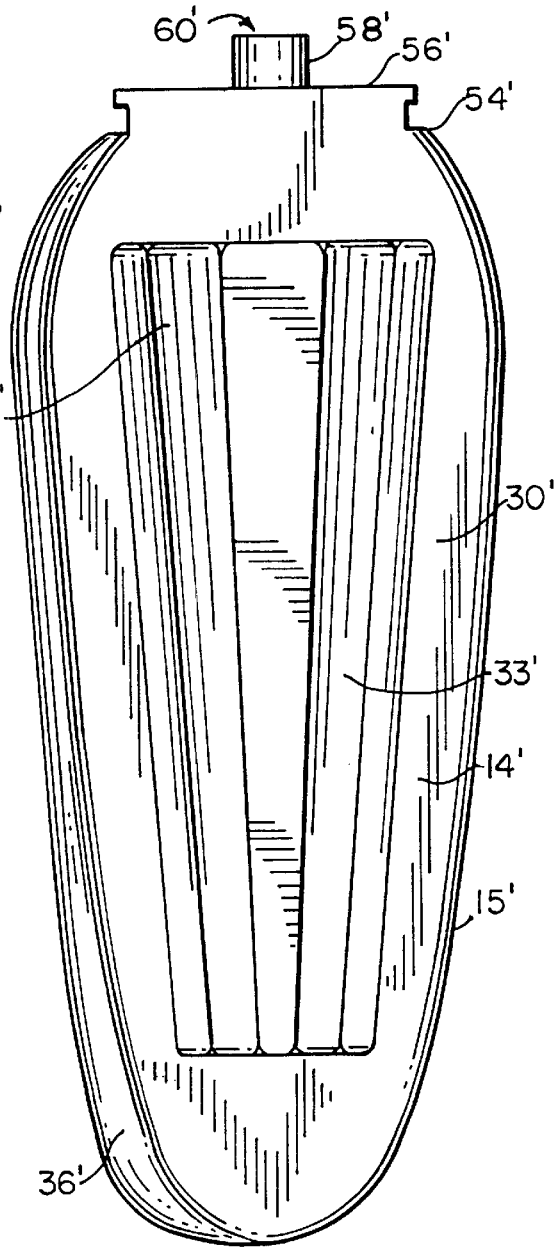

FIG.5
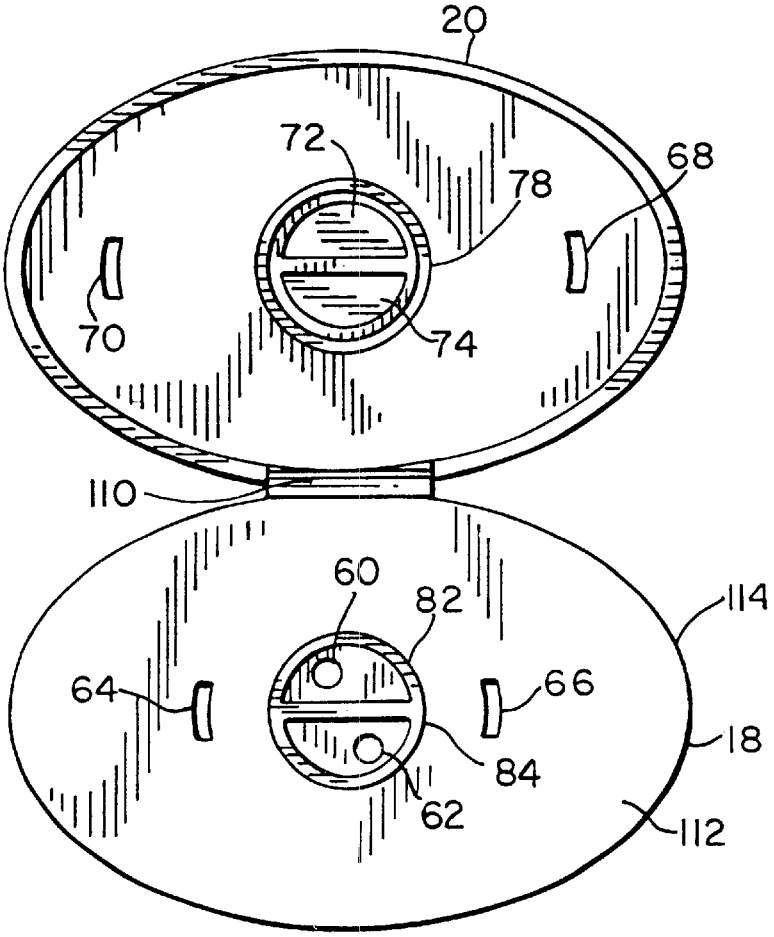
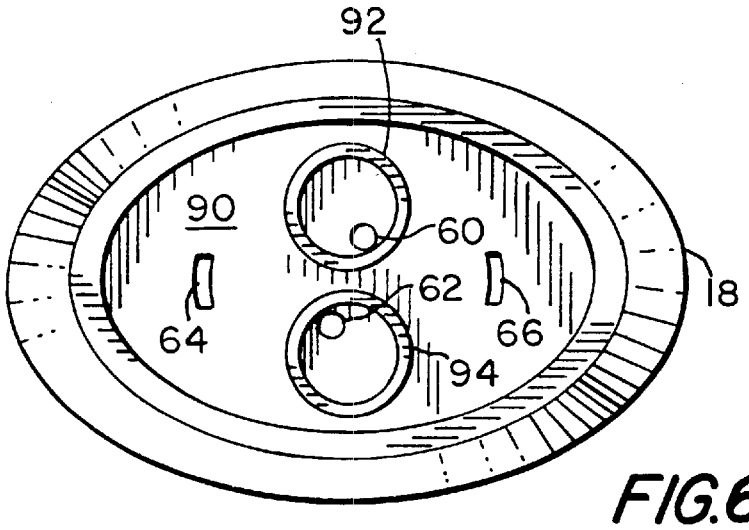
FIG.6

FIG. 7
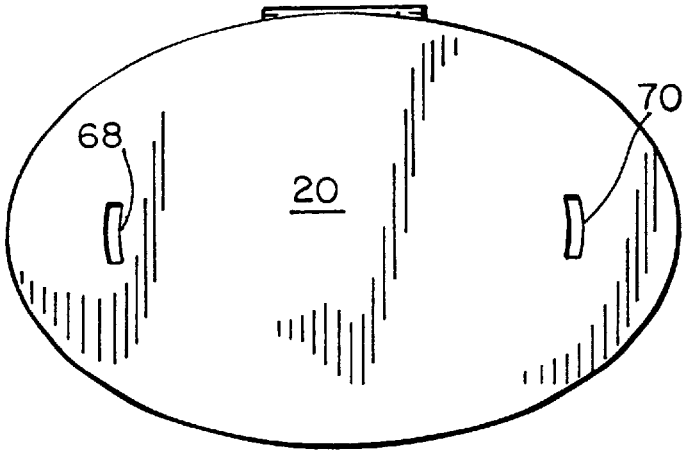
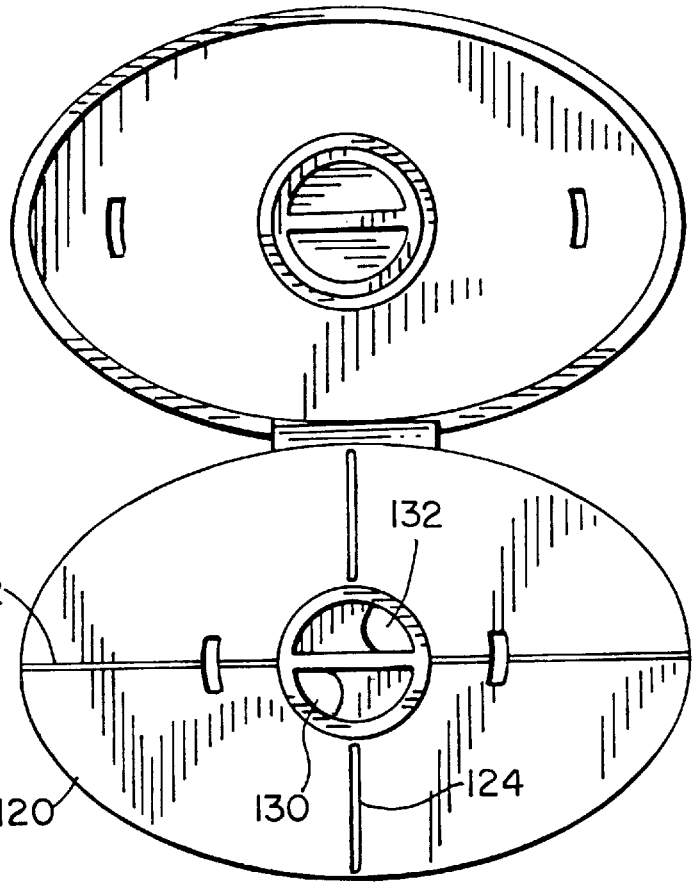
FIG. 8

CONTAINER AND CLOSURE

BACKGROUND OF THE INVENTION

It is often desirable in consumer and other products to keep separate two or more components of the composition until actual use. Examples of compositions wherein this may be desirable include personal washing compositions wherein cleansing and moisturizing compositions are kept separate prior to application on the skin by the consumer. A patent disclosing such a personal washing composition is Chambers et al., U.S. Pat. No. 5,612,307. Other examples include laundry products wherein it is desirable to keep separate enzyme and bleach, and dental products wherein it may be necessary to isolate peroxide from bicarbonate prior to use of the product. Another application for such containers is to house shampoo in one compartment and conditioner in another.

Numerous patents disclosing dual containers of one sort or another and/or closures have been published. These include Usen et al., U.S. Pat. No. 5,628,429, Hatakeyama et al., U.S. Pat. No. 5,615,803, Blette, U.S. Pat. No. 5,386,928, laia et al., U.S. Pat. No. 5,318,203, Douglas et al., U.S. Pat. No. 5,316,159, O'Meara, U.S. Pat. No. 5,269,441, O'Meara, U.S. Pat. No. 5,244,120, Reil et al., U.S. Pat. No. 5,158,209, De Latorcade, U.S. Pat. No. 5,152,432, Stokes et al., U.S. Pat. No. 5,137,178, Ratclift, U.S. Pat. No. 5,052,590, Pearson et al., U.S. Pat. No. 4,974,756, Gentile U.S. Pat. No. 5,392,947, Mueller U.S. Pat. No. 5,964,539, Gentile U.S. Pat. No. 5,252,312, Gentile U.S. Pat. No. 5,289,949, Gentile U.S. Pat. No. 5,289,950, Abfier et al. U.S. Pat. No. Des. 353,326, Wickham U.S. Pat. No. 5,489,046, Walravens U.S. Pat. No. Des. 329,984 and Meurer et al., U.S. Pat. No. 3,269,389.

A special problem which is encountered in the manufacture of dual containers is that of adhering effectively the containers to each other. Hot melt adhesives are a preferred type of adhesive since they often achieve the best and immediate bonding of the polyolefin material. While hot melt adhesives have the above advantageous characteristics, problems can be encountered with dual containers secured together by a hot melt adhesive, particularly when the containers are subjected to a wide range of temperatures and dynamics during shipping, storage, retail display and use by the consumer.

SUMMARY OF THE INVENTION

The invention is directed to a dual container having separately fabricated container chambers which is capable of maintaining its integrity notwithstanding large variations in temperature. In accordance with the invention, the chambers are adhered to each other with at least two different adhesives, preferably two different hot melts. The different adhesives are selected so as to provide maximum adherence at different temperatures, so that the chambers will remain adhered together when experiencing distribution forces over a wide temperature range. For example, in a preferred embodiment of the invention, a stiffer cohesive hot melt, which is more dimensionally stable is placed near the neck and near the bottom of the container. This type of hot melt performs better at higher temperatures and keeps the container assembly in proper alignment. A softer pressure sensitive hot melt may be used in the middle and at the very bottom of the container assembly. The softer hot melt is very tacky and so works well at lower, rather than higher temperatures. At higher temperatures it can become unduly soft and spread. Softer hot melt has good impact resistance.

By using two hot melts, advantage can be taken of their different and complementary advantageous features. This is particularly advantageous since the containers can be subjected to a variety of forces under a variety of conditions, e.g. temperature extremes after manufacture. Thus, by selecting the adhesive in accordance with the invention the containers will be able to endure a given applied force at both temperature extremes (high and low) whereas with a single type adhesive it might only have been able successfully to withstand the stress had it occurred at one of the temperature extremes, e.g. low temperature.

In the case of hot melt, preferably one of the hot melts employed is one which is classified as a pressure sensitive hot melt, which is pliable at room temperature and more impact resistant. It provides superior lower temperature bonding at from 0° F. to 40° F. A second hot melt preferably is a conventional cohesive hot melt, which is firmer and which provides superior, firmer bonding at temperatures of 70° F. to 120° F.

In another embodiment, the invention relates to a method for securing together two chambers of a dual chamber container using the two adhesives described above. Indeed, while the invention is described and is particularly applicable to securing together two chambers of a dual chamber container, it may find applicability in other circumstances wherein it is desired to use adhesive to adhere together two objects, particularly where it is desirable to keep the objects secured notwithstanding the possibility of exposure to a wide variety of temperatures. Thus the invention relates to the method of securing such objects and to the objects secured using the two adhesives.

The invention is particularly useful for securing two separate thermoplastic chambers. Adhering the chambers with, for example, two separate hot melt adhesives results in a much stronger bond over a wider temperature range than can be achieved with a single hot melt adhesive.

The invention finds particular application for dispensing two products kept separate prior to application, for example, surfactant and skin benefit agent. Such a container may comprise two chambers, each, having a proximal wall and a distal wall. The chambers are preferably adhered to each other at the proximal wall in accordance with the present invention.

In the further preferred embodiment, the invention is used to secure the chambers of the dual container of Markey et al., U.S. patent application Ser. No. 09/123,296 the disclosure of which is hereby incorporated by reference herein. Although the preferred chambers are essentially identical when viewed from their respective distal walls, they are adhered to each other at an offset so that from any view, both chambers can be seen. This is advantageous in that it permits the consumers to recognize that two separate chambers, and therefore, components, are used notwithstanding the fact that a unitary container is presented. Preferably, the chambers include in their proximal walls complementary raised and recessed portions, eg. protuberances and depressions, which assist the alignment of the chambers in an offset. Likewise, the chambers may be provided with generally longitudinally extending ridges or wedges, which facilitate joining of the chambers in an offset orientation.

Advantageously, the chambers of the container are made of a material which permits the distal walls to be relatively flexible so as to permit a consumer to dispense the product merely by exerting pressure with one hand. A particularly preferred material is medium density polyethylene. In fact, preferably both chambers are made of medium density polyethylene, although softer materials may also be used. Preferably, the ridge disposed on the proximal wall extends in a generally vertical orientation. Preferably aspects of the proximal walls medial to the ridge may be relatively flat, except for raised and recessed portions desirable to align the chambers, in order to permit the chambers to fit readily together. The chambers are adhered together with an adhesive in accordance with the present invention.

An especially preferred alignment scheme comprises a generally vertically extending secondary ridge and a complementary generally vertically extending trough on each of the proximal walls. The adhesives used according to the invention will generally be disposed outside any protuberances or depressions.

Each chamber preferably includes a product exit opening. Typically, the product exit openings lead to a closure.

The closure may include a peripheral flange and a wall extending transversely of the flange and including at least two product egress openings. A closure cover may be attached to the closure base, for example by a hinge. The closure cover may include one or more plugs to assure that product does not escape through the product egress openings when the closure cover is closed.

Both the closure base transverse wall and the closure cover preferably includes one or more drainage openings.

The cover of the closure preferably provides a relatively large surface area so that, if so desired, the container can be conveniently left to stand on the closure.

For even dispensing, it is preferred that the viscosities of the liquids in each chamber be as close as possible to the other.

For a more complete understanding of the above and other features and advantages of the invention, reference should be made to the following detailed description of preferred embodiments and to the accompanying drawings.

BRIEF DESCRIPTION OF THE DRAWINGS

FIG. 4 is an elevational view of the proximal. walls of the two chambers of the invention.

FIG. 5 is a top view of a closure for a container according to the invention with the cover in the open position.

FIG. 6 is a bottom plan view of a closure for a container according to the present invention.

FIG. 7 is a top plan view of a closure for a container of the invention with the cover closed.

FIG. 8 is a top plan view of a closure for a container according to the invention with the cover open.

DETAILED DESCRIPTION OF THE INVENTION

Container 10 comprises closure 12 and two chambers, 14 and 14'. Closure 12 includes base 18 and cover 20.

Figure 1:
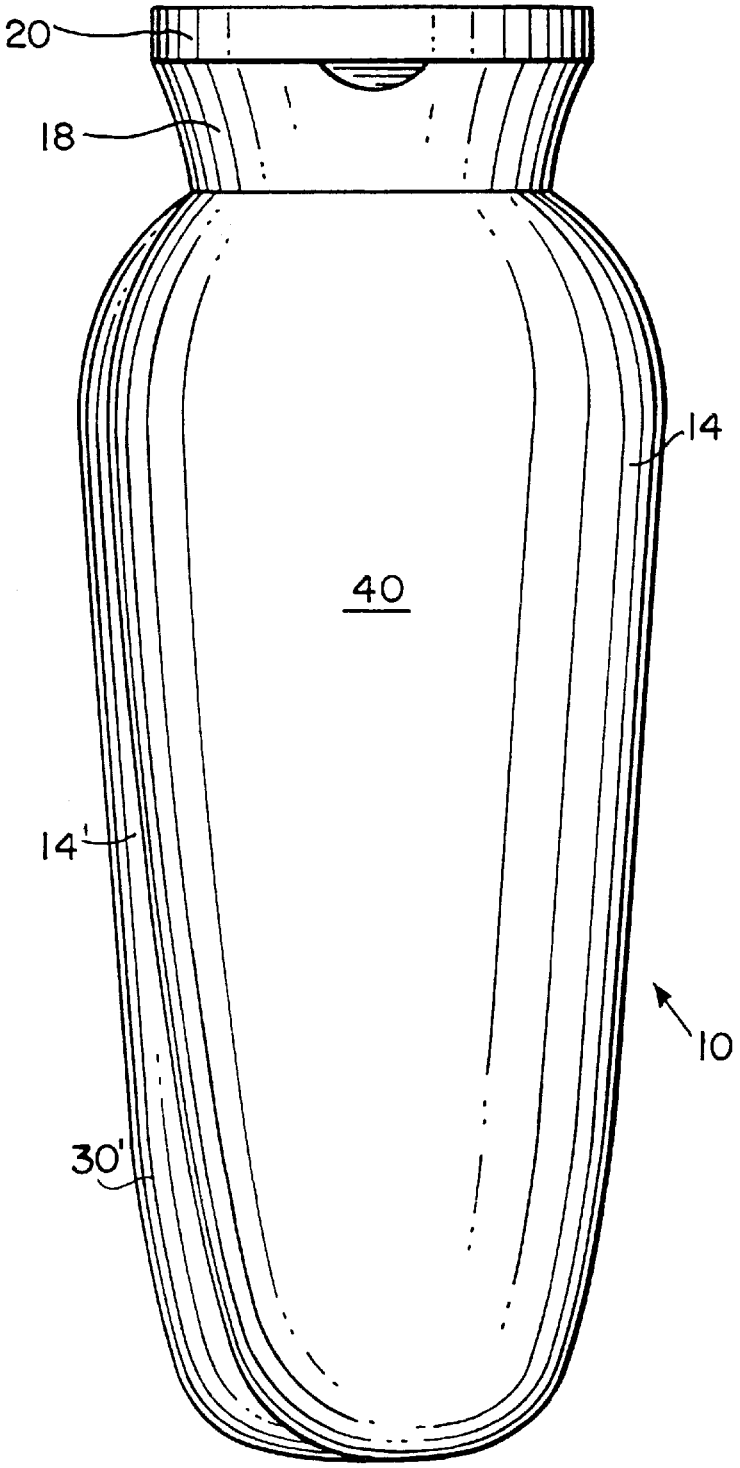
FIG. 1 is front elevational view of a container in accordance with the invention.
Figure 2:
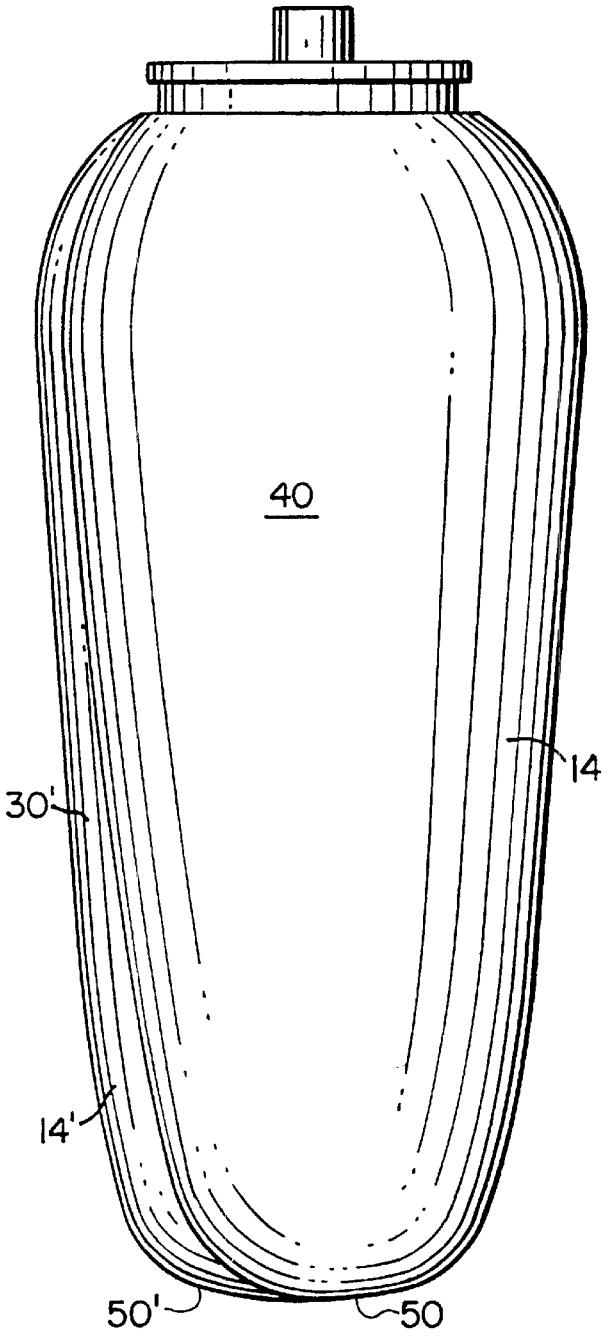
FIG. 2 is a front elevational view of a container according to the invention with the closure removed.

As especially seen in FIGS. 1, 2 and 4, although chambers 14 and 14' have transverse profiles and front plan views which are identical or essentially identical, they are disposed at an offset to each other so that from any view, even the front elevational view of FIGS. 1 and 4, both chambers can be seen. Thus, the fact that two separate chambers comprise the container can be readily ascertained by the consumer and the fact that two separate components are included can be readily deduced. The fact that two identical chambers may be used is advantageous, particularly in that manufacturing effort and costs can be minimized since only one chamber design, mold, etc. need be used.

Figure 3:
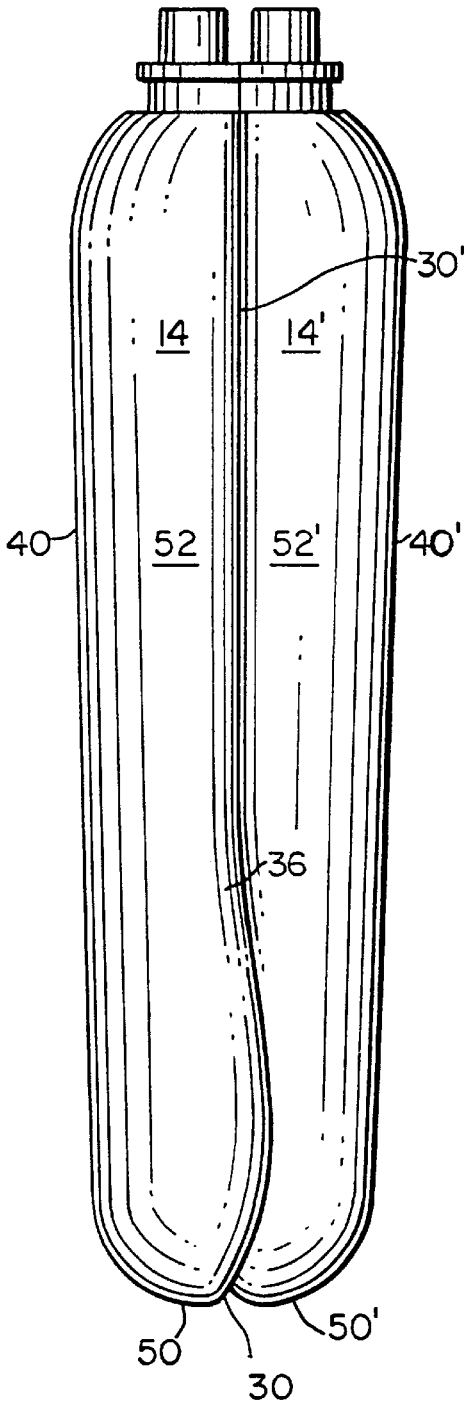
FIG. 3 is a side elevational view of a container according to the invention with the closure removed.

Chambers 14, 14' comprise proximal walls 30, 30' (see especially FIG. 4) at which the chambers are joined. Proximal walls 30 and 30' include ridges or wedges 36, 36' which extend generally vertically along one side of each of the proximal walls. These ridges assist in positioning the chambers so that they are offset. For instance, when the container is assembled so that proximal walls 30, 30' face and touch each other (see, especially, FIG. 3), ridges 36 and 36', respectively, are disposed laterally to rounded side edges 15', 15 (respectively) of side walls 52', 52 and serve to retain the side edges medially to the respective ridges. In addition, proximal wall 30 preferably includes raised areas and recesses such as vertically extending trough 33. Proximal wall 30' likewise preferably includes secondary ridge 32 and trough 33. Ridges 32, 32' receive troughs 33, 33' when the chambers are joined back to back along the proximal walls.

It will be appreciated that the ridges and troughs may of course be of a variety of shapes so long as they are complementary. For instance, male/female pin/hole arrangements could be used. The troughs and ridges or other recesses and protuberances are disposed on the proximal walls in positions such that the chambers 14, 14' will be offset as seen in FIG. 1.

Much of the region of proximal walls 30, 30' medial to ridges 36, 36', other than ridges 32, 32' and troughs 33, 33' is flat, or relatively so, in order to permit the chambers to adhere well to each other.

Opposite proximal walls 14, 14' are distal walls 40, 40'. These are the walls to which the consumer will apply pressure in dispensing the product and need not be as flat as the proximal walls. That is, they may be somewhat rounded. Distal walls 40, 40' are made of a flexible material which permits the consumer to apply pressure by merely moving his or her fingers together while holding the container in one hand. Preferably the distal walls, and indeed preferably each of the entire chambers, are made of medium density polyethylene. Especially preferred is polyethylene having a density of from about 0.926 to about 0.94 g/cc. It is believed that such densities of polyethylene promote uniform dispensing of product from both of the chambers simultaneously. Uniform dispensing of product is also promoted by ensuring that the viscosities of the products in the chambers are identical, or as close to each other as possible.

Chambers 14, 14' also include bottom walls 50, 50', a first shoulder 54, 54', a second shoulder 56, 56' and a finish 58, 58' leading to product exit opening 60, 60'.

Base 18 of closure 12 includes product egress openings 60, 62 and drainage apertures 64, 66. Cover 20 includes cover drainage openings 68, 70, plugs 72, 74 and inner flange 78. Plugs 72, 74 are accommodated within half moon flanges 82, 84 to help seal the container when the cover is in the closed position. Likewise flange 78 surrounds the two half moon flanges 82, 84 to keep the product from exiting the container when the container is closed.

Depending from the underside 90 of closure 18 are product egress channels 92, 94, which lead respectively to product egress openings 60, 62 in chambers 14, 14'. The channels serve to direct product from chamber finishes 58, 58' to product egress openings 62, 60, without permitting any extraneous liquid, e.g., shower water, to enter the product streams.

Extraneous liquid travels through drainage openings 64, 66 in base 18 and through product drainage openings 68, 70 in cover 20 when the cover is closed. Extraneous shower water and other liquid are best avoided for aesthetic and hygienic reasons.

The closure is preferably a flip top type closure wherein the base 18 and the cover 20 are connected by hinge 110 which is of the flip top type. Preferably the closure is injection molded and is made of polypropylene.

The chambers are filled through the product exit openings 60, 62 in the chambers prior to snap fitting the closure onto shoulders 56, 56'. The product egress openings 60, 62 are disposed in wall 112, which extends transversely of base flange 114.

In accordance with a preferred embodiment illustrated in FIG. 8, closure base 120 includes a longitudinal or major axis 122 and a minor or transverse axis 124. Advantageously, product egress openings 130, 132 are substantially disposed on opposite sides of both axes. This permits the user better to distinguish the dual product streams.

The dual chamber or "tottle" arrangement provides positioning, alignment and proportioning for proper consumer ergonomics and dispensing, as compared to side to side positioning. The orientation and proportioning also allows a front and back label area for retail merchandising.

Figure 9A:
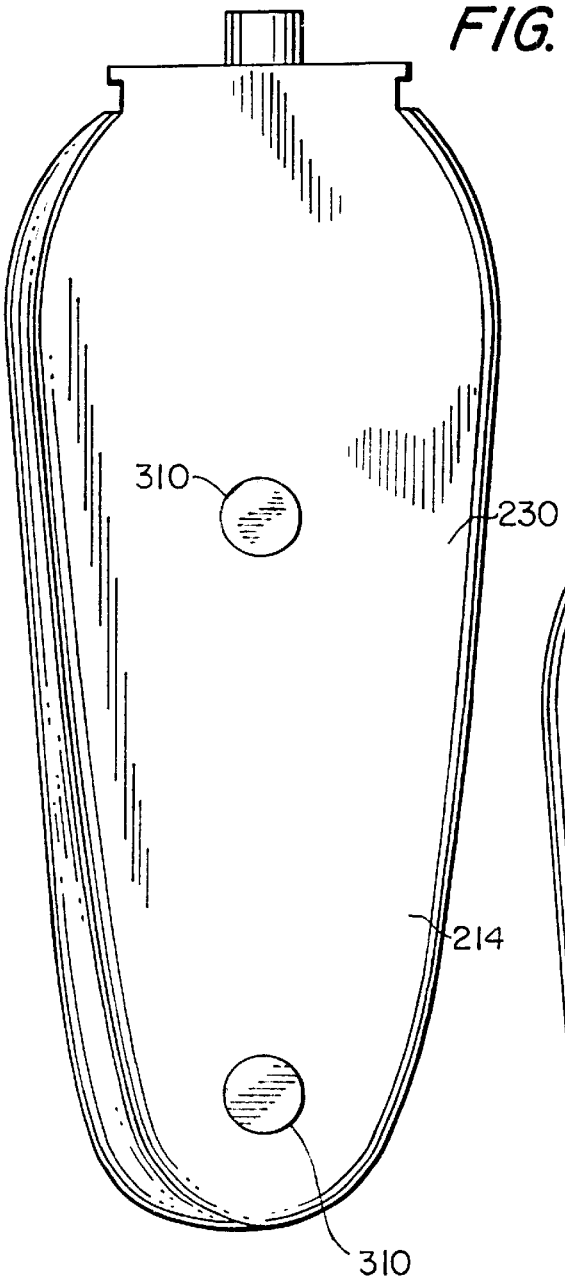
FIG. 9 is an elevational view of the proximal walls of the chambers of the container of the invention similar to FIG. 4 except that protuberances and depressions are omitted and a pattern of application of adhesive is added.
Figure 9B:
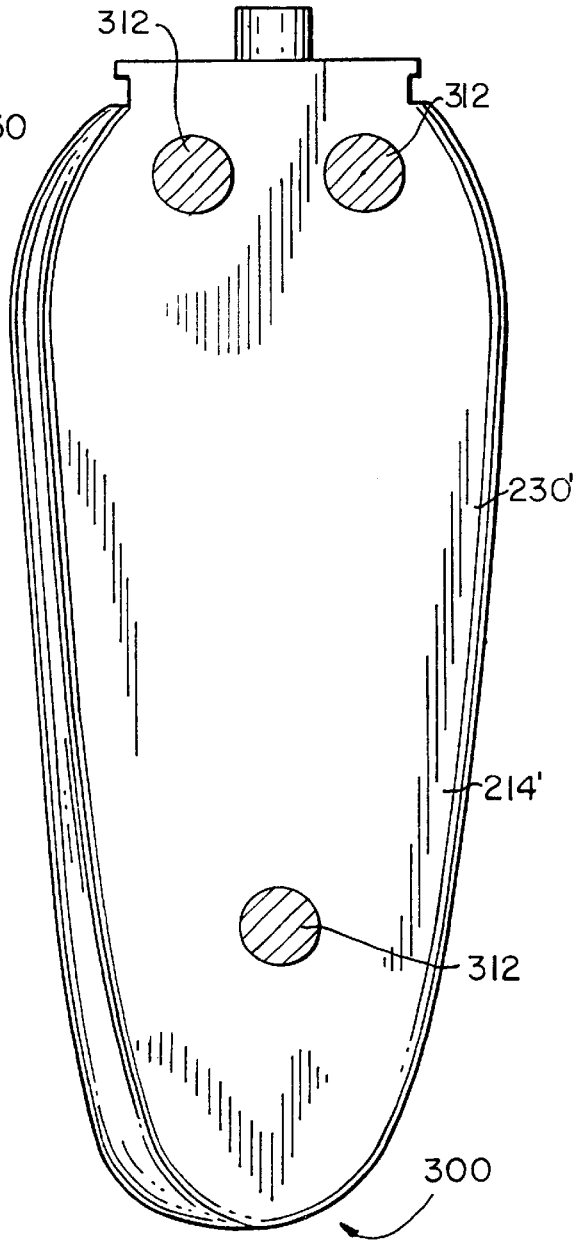

As seen in FIG. 9, adhesive will generally be applied to proximal walls 230, 230' of chambers 214, 214'. As can be seen from FIG. 9 and the description below, two different adhesive agents are present at a plurality of different locations in said container. As will be appreciated by those of ordinary skill, adhesive may be applied in various patterns. Typically, adhesive will be placed in locations on the proximal walls other than the mating locations of the complementary recesses and protuberances described above, although in appropriate cases adhesive may be placed in recesses or on protuberances. In FIG. 9, recesses and protuberances are omitted for clarity. The container design, with the closure on the egress end, and even with the use of the proximal wall mating locations, makes the container assembly somewhat more subject to shock and cleavage stresses, particularly for sizes larger than 8 oz.

In accordance with the invention, dual container 300 defined by chambers 214 and 214' includes at least two types of hot melt for adhering the chambers together. Chamber 214 includes dots of hot melt 310. Hot melt 310 is a pliable pressure sensitive hot melt (such as Henkel Euromelt 362) which is softer and more impact resistant. It is used for the bottom of the chamber, particularly toward the very bottom, to keep the chambers from breaking apart upon impact. The pliable pressure sensitive hot melts perform better in lower temperature conditions of from 0° F.–40° F. The cured bond of the softer hot melt is soft and very tacky; a broken bond can be adhered back together like chewing gum on a hot pavement.

Chamber 214', on the other hand, includes adhesive dots 312 which comprise a firmer cohesive hot melt such as National hot melt Instant Lok™ 34–2787, which is a firmer hot melt and which has high temperature dimensional stability. This hot melt is more dimensionally stable and is sued particularly to keep the chamber necks in proper alignment. Firmer hot melts in accordance with the invention have better adhesion and impact resistance from 70° F. to 120° F. Examples of other firm hot melt adhesives which can be employed include National Starch Instant Lok 34–2787, National Starch Instant Lok 70–3769, and Findley 795–334. With the firm, more cohesive hot melt, once the bond is broken it cannot be reattached. The cured bond resembles wax. The firmer cohesive hot melt is placed as close as possible to the container necks. This keeps the containers in proper alignment for capping. The pliable pressure sensitive hot melt is positioned more towards the closed container ends for best resistance to stock and cleavage stresses, especially at lower temperatures. Both hot melts are interdispersed in the middle.

Although hot melt is the preferred adhesive, it is believed that other adhesives may be used as well. Or, a combination of hot melt and non-hot melt adhesives may be used, for instance, one hot melt adhesive and one non-hot melt adhesive. In accordance with the present invention, the two different adhesives used should afford maximal protection at different temperatures, so that the dual container can maintain its integrity over a range of temperature conditions and applied forces.

While the invention has been described with respect to adhering two specific chambers of a dual container together, the invention may be used to adhere together other chambers of other dual containers, especially where the materials are thermoplastic. Moreover, the invention may be used to adhere together other objects, again particularly thermoplastic objects, especially where it is desired to ensure that the object will remain secured together during exposure to a range of temperatures.

Preferably the container of the invention is used to receive a liquid personal wash cleaning formulation which includes a surfactant. Desirably the cleaning formulation also includes a skin conditioning and moisturizing ingredient. Preferably one chamber contains a surfactant composition and the other chamber includes a moisturizing composition. The surfactant should be a relatively mild surfactant suitable for washing human skin and may be, e.g., an anionic, amphoteric, cationic or nonionic surfactant. It is preferred that the surfactant is a foaming surfactant. Among the mild surfactants which may be used are cocamidopropyl betaine, and sodium lauroamphoacetate, sodium cocoylisethionate. Among other surfactants which may be used are soap and sodium laureth sulfate.

Preferably surfactants are employed such that the surfactant, if used alone, or the surfactant mixture is milder than would be soap itself as measured by the zein solubilization test (soap yields 80% zein solubilized). Preferably the zein solubilization is less than 60%.

Other ingredients such as thickeners like ammonium sulfate and opacifiers such as mica/titanium dioxide may be used. Water, of course, may also be included.

The surfactant is preferably present at a level of from 2 to 50 wt. % of the total composition (ie. Including both chambers), especially from 5 to 25 wt. % of the cleansing composition.

The moisturizing agent is preferably present at from 0.5 to 35 wt. %, especially from 2 to 20 wt. % of the total composition. Moisturizers may include oils, cationic, and certain nonionic and anionic surfactants. Among the moisturizers which may be used are glycerin mono, di and triesters, vegetable oil, epidermal and sebaceous hydrocarbons such as lanolin, squalene, cholesterol and derivatives such as esters, mineral oil, silicone gum and silicone oil. One such moisturizer is the dimethicone emulsion sold as Dow Q2-1656, which is a 50% silicone emulsion. Other polyols which may be used include, but are not limited to glycerol, propylene glycol and polyethylene glycol. The moisturizer may be water-soluble or oil-soluble. In the latter case the overall composition may be an emulsion.

Further additional ingredients which may be employed include preservatives, pH adjusting agents such as citric acid and sodium hydroxide, perfumes, dyes, suspending agents such as magnesium/aluminum silicate, and sequestering agents such as EDTA.

The compositions held in the container can be applied to the skin by hand or by use of a personal washing implement such as a sponge, a loofah, a polymeric netted mesh pout, etc.

EXAMPLE 1

(Prophetic)

Two chambers of the container illustrated in FIGS. 1–8. are adhered together using two dots of a pliable pressure sensitive (such as Henkel Euromelt 362) hot melt, (one toward the center and one toward the bottom approximately as shown in FIG. 9) and three dots of a firmer cohesive hot melt such as National hot melt 34-2787 (two at the top and one toward the bottom approximately as shown in FIG. 9). The chambers of the dual container enjoy good integrity remaining adhered together throughout a wide range of temperature conditions. The dual container also enjoys good impact resistance throughout a wide range of conditions. The chambers are made of medium density polyethylene and the closure is made of polypropylene.

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A method for adhering at least two separate thermoplastic objects together into a combined object to maintain the integrity of the combined object over a range of temperatures comprising adhering the separate objects together with at least two different adhering agents at different locations.

2. The method according to claim 1 wherein at least one adhering agent is a hot melt.

3. The method according to claim 2 wherein the adhering agents compromise at least two different hot melts.

4. A dual container comprising a first chamber adhered to a second chamber with at least two different adhering agents at different locations.

5. The dual container according to claim 4 wherein at least one of said adhering agents is a hot melt.

6. The dual container of claim 4 wherein said container is made of thermoplastic.

7. The dual container of claim 5 wherein at least two adhering agents are hot melts.

8. A combined object formed from at least two separate thermoplastic objects together wherein the separate objects are adhered together by at least two different adhering agents at different locations.

9. The combined object according to claim 8 wherein at least one of the adhering agents is a hot melt.

10. The method according to claim 9 wherein the adhering agents compromise at least two different hot melts.

11. The dual container according to claim 4 wherein said at least two different adhering agents comprise at least one pressure sensitive hot melt and one coherent hot melt.

12. The method according to claim 1 wherein said at least two different adhering agents comprise at least one pressure sensitive hot melt and one coherent hot melt.

13. The combined object according to claim 8 wherein said at least two different adhering agents comprise one pressure sensitive hot melt and one coherent hot melt.

14. A dual container comprising a first chamber adhered to a second chamber with at least two different adhering agents at a plurality of different locations on said container.

15. A method for adhering at least two separate thermoplastic objects together into a combined object to maintain the integrity of the combined object over a range of temperatures comprising adhering the separate objects together with at least two different adhering agents at a plurality of different locations on said container.

16. A combined object formed from at least two separate thermoplastic objects together wherein the separate objects are adhered together by at least two different adhering agents at a plurality of different locations on said object.

* * * * *